United States Patent [19]

Ernest et al.

[11] Patent Number: 5,058,300

[45] Date of Patent: Oct. 22, 1991

[54] SIGNHOLDER

[75] Inventors: Richard C. Ernest, Lake Forest, Ill.; P. Paul Retzinger, Cupertino, Calif.

[73] Assignee: Crown Metal Manufacturing Company, Chicago, Ill.

[21] Appl. No.: 430,628

[22] Filed: Nov. 2, 1989

[51] Int. Cl.[5] ..... G09F 15/00

[52] U.S. Cl. ..... 40/606; 40/611; 40/661; 40/152.1; 40/607

[58] Field of Search ..... 40/606, 607, 611, 661, 40/642, 158.1, 155, 152.1; 52/788

[56] References Cited

U.S. PATENT DOCUMENTS

| | | | |
|---|---|---|---|
| 1,980,453 | 11/1934 | Tucker et al. | 40/152.1 |
| 2,050,136 | 8/1936 | Tucker et al. | 40/152.1 |
| 2,223,308 | 11/1940 | Rovell | 40/152.1 |
| 2,229,266 | 10/1942 | Engel | 40/158.1 X |
| 2,708,774 | 5/1955 | Seelen | 52/788 |
| 2,833,072 | 5/1958 | Gregory | 40/152.1 |
| 4,165,572 | 8/1979 | Sussman | 40/661 |
| 4,594,802 | 6/1986 | Field | 40/661 |
| 4,726,132 | 2/1988 | Ernest | 40/611 X |
| 4,726,132 | 2/1988 | Ernest | 40/661 |
| 4,777,750 | 10/1988 | Garfinkle | 40/606 X |
| 4,790,093 | 12/1988 | Ernest | 40/152.1 X |

*Primary Examiner*—Kenneth J. Dorner
*Assistant Examiner*—J. R. Hakomaki
*Attorney, Agent, or Firm*—Silverman, Cass & Singer, Ltd.

[57] ABSTRACT

A signholder subassembly for use with a retaining bracket and a pair of clear, relatively flexible planar pieces. Each of the planar pieces has a face surface and is substantially identical to one another and adapted to be mated to one another and mounted along a bottom edge in the retaining bracket by the subassembly. The subassembly includes an insert capable of holding the planar pieces and is mountable within the retaining bracket. A member is included for biasing the planar pieces toward one another to form a bearing surface therebetween and create a gripping action between the face surfaces of the planar pieces when they are mounted within the insert and the retaining bracket. A member also is included for restraining the insert within the retaining bracket.

4 Claims, 1 Drawing Sheet

Fig. 1
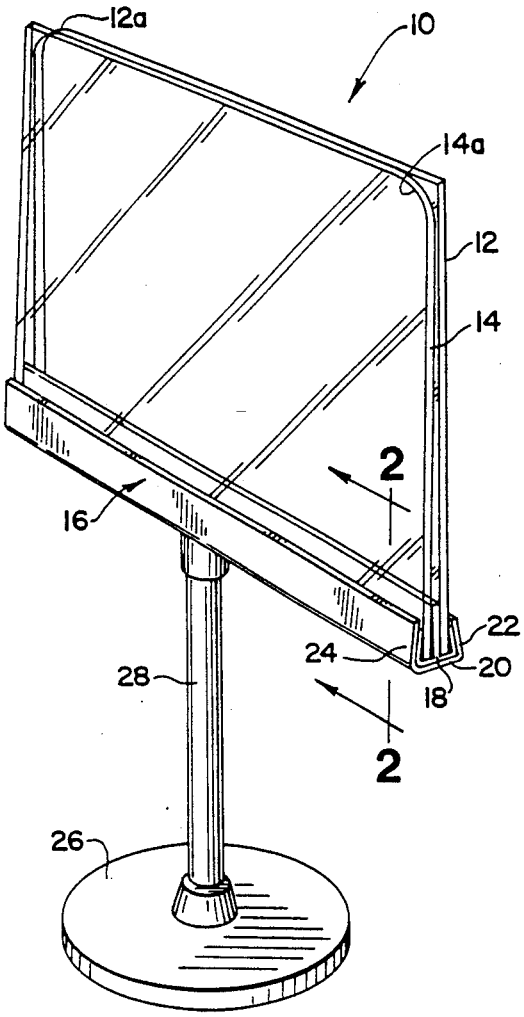
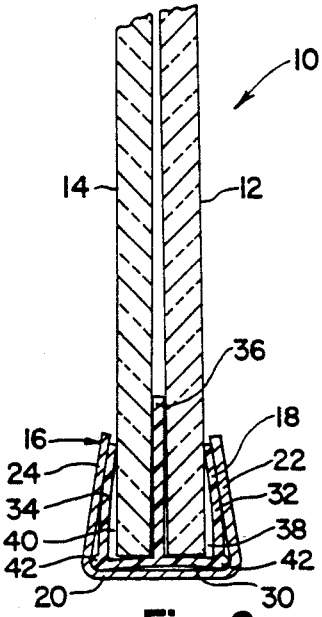
Fig. 2
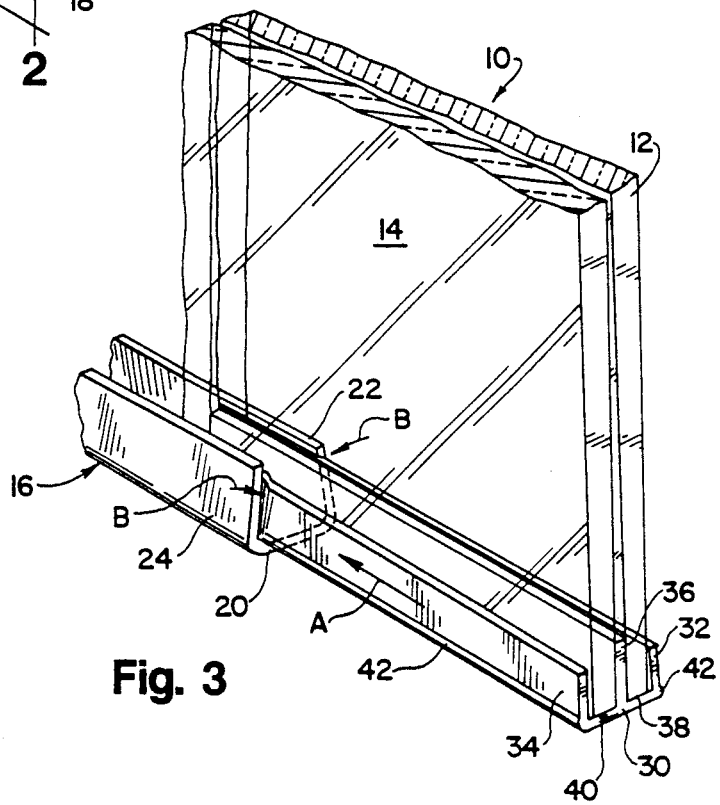
Fig. 3

SIGNHOLDER

FIELD OF THE INVENTION

This invention relates generally to signholders and more particularly, to a molded plastic signholder and bracket having an insert for retaining two planar pieces within the bracket and providing a bearing surface therebetween.

BACKGROUND OF THE INVENTION

Signholders having a frame for supporting display cards, sheets or signs are known in the art. One type of signholder, for example, includes a metal bracket into which the sign can be inserted and which provides a metal support frame around the entire periphery of the sign. Such signholders typically are designed to be mounted onto a pedestal, hung from a bracket or mounted to a convenient surface.

It also is known to provide a plastic type signholder which can be mounted along one edge in a metal retaining bracket. These plastic signholders have been developed in one or two pieces with the plastic material providing the support for the sign, poster or card.

An example of such a signholder is disclosed in U.S. Pat. No. 4,726,132 which is assigned to the same assignee as the assignee herein. That signholder includes a two-piece molded plastic signholder and bracket which provides a top bearing surface between the two pieces to clamp the signs or cards therebetween. The two molded plastic pieces are reverse mirror images of one another and include positive engagement interlocking members along their bottom edges to align the two pieces. The retaining bracket is U-shaped including inwardly inclined bearing edges which bear against inclined bearing members provided along the bottom edge of the two pieces to ensure that the upper surfaces of the two pieces bear against one another to provide the desired clamping. Although such a signholder has been found to be useful, the molding of the two pieces to include the positive engagement and alignment members is somewhat intricate thereby providing increased molding costs.

It therefore would be desirable to provide a signholder having two planar pieces for engagement in a bracket where the planar pieces do not need the positive engagement members or the inclined bearing edges formed along their bottom edges and which still provides the desired bearing surface and alignment of the planar pieces. Such a signholder also should readily be removable from the bracket for cleaning or replacement.

SUMMARY OF THE INVENTION

A signholder and subassembly for use with a retaining bracket and a pair of clear, relatively flexible planar pieces. Each of the planar pieces has a face surface and is substantially identical to one another and adapted to be mated to one another and mounted along a bottom edge in the retaining bracket by the subassembly. The subassembly includes an insert capable of accepting the planar pieces and is mountable within the retaining bracket. The retaining bracket is formed to bias the planar pieces toward one another to form a bearing surface therebetween and create a gripping action between the face surfaces of the planar pieces when they are mounted within the insert and the retaining bracket.

The insert also includes a member for restraining the insert within the retaining bracket.

BRIEF DESCRIPTION OF THE DRAWINGS

FIG. 1 is a perspective view of the signholder embodying the invention;

FIG. 2 is a cross-sectional view of the signholder taken along line 2—2 of FIG. 1 and in the direction indicated generally, illustrating the planar pieces within the insert and the retaining bracket; and FIG. 3 is a partial perspective view of the signholder of FIG. 1 illustrating partial placement of the insert and the planar pieces within the retaining bracket for completing the assembly.

DESCRIPTION OF THE PREFERRED EMBODIMENTS

Referring to FIGS. 1–3, a signholder of the invention is designated generally by the reference numeral 10. The signholder 10 includes two planar pieces 12 and 14, a retaining bracket 16 and an insert 18.

Generally, in operation, the signholder 10 is utilized to hold a card, sheet or sign (not illustrated) between the two planar pieces 12 and 14. Thus, in order to maintain such a card, sheet or sign between the two planar pieces 12 and 14, it is necessary to establish a bearing surface between the two planar pieces 12 and 14 near their top edges to grip the card, sheet or sign therebetween. Such a bearing surface and gripping action are accomplished by the interaction between the two planar pieces 12 and 14, the bracket 16 and the insert 18 as will be described in detail below.

The two planar pieces 12 and 14 preferably are substantially identical flat sheets and are formed of a clear relatively flexible plastic material which has a low cost, is substantially shatterproof and readily can be molded. In general, the plastic material can be selected from any of a number of clear synthetic plastic materials which are suitable for injection molding. These properties, with the exception of low cost, can be provided by high quality polycarbonate like materials. One specific suitable plastic material is a resin sold by the Eastman Kodak Company under the tradename KODAR, which also is a low cost material. Another example of a suitable plastic material is an acrylic type resin.

Additionally, in order provide increased gripping of the bearing surface provided between the two planar pieces 12 and 14, the pieces 12 and 14 preferably are molded with a slight inward warp or curvature (not illustrated). Thus, when the two pieces 12 and 14 are assembled in the insert 18 and the bracket 16, the desired increased gripping is achieved.

In order to assist in insertion of a desired sign between the two planar pieces 12 and 14, the planar pieces 12 and 14 can be formed with different heights (not illustrated). Alternatively, as FIG. 1 illustrates, one corner 12*a* or 14*a* of at least one planar piece 12 or 14 can be rounded off while the corner of the opposing planar piece remains square. In either case, a portion of a planar piece 12 or 14 extends away from the opposite planar piece so that a user can grasp the extended portion of the piece 12 or 14 to pull the planar pieces apart for insertion of the sign. Furthermore, for insertion, the sign or card itself can abut the extended portion and be forced between the two planar pieces 12 and 14 by a user.

The bracket 16 preferably is formed from metal as a U-shaped channel member having a predetermined length which typically is based upon the desired size of the sign to be displayed. The bracket 16 is defined by a base 20 and upstanding leg members 22 and 24 integrally formed on either edge of the base 20 and extending in the same direction away from the base 20. Preferably, the leg members 22 and 24 are of approximately the same height and are inwardly inclined or tapered to provide a biasing force to retain the insert 18 and the planar pieces 12 and 14 within the bracket 16 as described below. Thus, the bracket 16 has a substantially dovetail shaped cross-sectional configuration.

Typically, the bracket 16 is designed to display a sign or similar article on top of a surface such as a counter or the like (not illustrated). Accordingly, as FIG. 1 illustrates, the bracket 16 can be connected to a base 26 through a stem 28. Alternatively, the bracket 16 can include any type of base arrangement or the base can be eliminated altogether.

The insert 18 is provided in order to mount both of the planar pieces 12 and 14 within the bracket 16 with the desired bearing surface provided between the planar pieces 12 and 14 as described above. Thus, the insert 18 preferably is formed as a U-shaped channel member having a predetermined length, similar to the bracket 16. As illustrated in the drawings, the overall dimensions of the insert 18 are slightly smaller than the dimensions of the bracket 16 so that the insert 18 can fit within the confines of the bracket 16.

As FIGS. 2 and 3 illustrate, the U-shaped insert 18 is formed by a base member 30 and first and second wall members 32 and 34 integrally formed on either edge of the base member 30 and extending in the same direction away from, and substantially parallel to, the base member 30. Preferably, the first and second wall members 32 and 34 are of approximately the same height.

In order to facilitate insertion of the insert 18 within the bracket 16, the insert 18 preferably is formed from a relatively resilient material, such as plastic. As with the planar pieces 12 and 14, the plastic material selected for the insert 18 should have a low cost, be flexible and shatterproof as well as being readily moldable, but need not be transparent. Alternatively, any other type of material having substantially the same properties can be utilized so long as the desired mounting of the planar pieces 12 and 14 within the bracket 16 is achieved.

In order to mount the planar pieces 12 and 14 within the insert 18, a longitudinal interior wall member 36 is provided within the the U-shaped insert 18 upstanding from the base 30 between the first and second wall members 32 and 34. Thus, first and second longitudinal channels 38 and 40 of substantially equal width are formed within the U-shaped insert 18, the width substantially corresponding to the thickness of the planar pieces 12 and 14.

Due to the dovetail cross-section of the bracket 16, when the insert 18 is inserted within the bracket 16 the inwardly inclined leg members 22 and 24 of the bracket 16 force or bias the wall members 32 and 34 of the insert 18 slightly inward. This inward bias enables the planar pieces 12 and 14 to be restrained within the channels 38 and 40 when assembled.

Alternatively, the bracket 16 can be formed with the leg members 22 and 24 substantially perpendicular to the base 20 and the insert 18 can be formed with a substantially dovetail shaped cross-sectional configuration (not illustrated). Thus, the insert 18 provides the inward bias to restrain the planar pieces 12 and 14 within the channels 38 and 40.

In order to assist in mounting the planar pieces 12 and 14 within a desired channel 38 or 40, the interior wall member 36 has a height slightly greater than the height of the first and second wall members 32 and 34. Accordingly, the planar pieces 12 or 14 readily can be mounted from the side of the insert 18 as well as from the end thereof.

Although the insert 18 sufficiently can be retained within the bracket 16 by the inward taper of the legs 22 and 24 of the bracket 16, the first and second wall members 32 and 34 of the insert 18 can include an outwardly projecting rib 42 to further assist in retention of the insert 18 within the bracket 16. The ribs 42 are positioned on the exterior surfaces of the wall members 32 and 34 near the base 30 and extend along the length of the wall members 32 and 34.

As FIG. 2 illustrates, the ribs 42 engage the base of the legs 22 and 24 proximate the base 20 of the bracket 16. Additionally, although the base 30 of the insert 18 initially is formed as a flat surface, upon insertion of the insert 18 within the bracket 16 the engagement of the ribs 42 with the legs 22 and 24 provides an inward force on the insert 18 thereby slightly bowing the center of the base 30 upwardly with respect to FIG. 2. Accordingly, this bowing action reduces the engagement surface between the base 20 of the bracket 16 and the base 30 of the insert 18 to reduce friction therebetween during insertion.

To assemble the signholder 10, the two planar pieces 12 and 14 preferably are inserted within the channels 38 and 40 of the insert 18. Next, as FIG. 3 illustrates, the insert 18, with the two planar pieces 12 and 14 therein, is slid into the bracket 16 from one end thereof in the direction indicated by arrow "A". Since the legs 22 and 24 of the bracket 16 are slightly inwardly inclined, they exert an inward force on the first and second wall members 32 and 34 of the insert 18, and thus the two planar pieces 12 and 14, in the direction indicated by arrows "B". At the same time, the ribs 42 slighty bow the base 30 of the insert 18 as described above. After the insert 18 and planar pieces 12 and 14 are slid all the way into the bracket 16 to the final position illustrated in FIG. 1, a desired card or sign can be inserted between the two planar pieces 12 and 14 as described above.

The signholder 10 also can be assembled by first mounting the insert 18 within the bracket 16 without the planar pieces 12 and 14. Then, the planar pieces 12 and 14 can be inserted within the channels 38 and 40 to their desired positions.

What is claimed and desired to be secured by Letters Patent of the United States is:

1. A signholder subassembly for use with a retaining bracket and a pair of clear, relatively flexible plastic planar pieces, each of said pieces having a face surface and being substantially identical to one another and adapted to be mated to one another and mounted along a bottom edge in said retaining bracket by said subassembly, said subassembly comprising:

an insert formed as a channel member having a substantially U-shaped cross-sectional configuration formed by a base and first and second wall members upstanding from said base and at least one interior longitudinal wall member upstanding from said base between said first and second wall members thereby forming two longitudinal channels within said U-shaped channel member, each of said channels capable of accepting a respective planar piece therein, each of said first and second wall members including an outwardly projecting rib on its exterior surface proximate said base and extending along the length of said first and second wall members for engagement with said retaining bracket so that when said planar pieces and said channel member are mounted within said retaining bracket said retaining bracket biases said first and second wall members and said planar pieces within said channels toward each other to form a bearing surface between said first and second wall members and said ribs restrain said channel member within said retaining bracket.

2. The signholder as defined in claim 1 wherein said retaining bracket is in the form of U-shaped channel member having a base and two leg members upstanding from said base and being slightly larger than said channel member for mounting said channel member within said retaining bracket.

3. The signholder as defined in claim 2 wherein said upstanding leg members of said retaining bracket are tapered inward as they extend away from said base so that said retaining bracket has a substantially dovetail shaped cross-sectional configuration to provide the bias to said first and second wall members of said channel member and said planar pieces.

4. A signholder comprising:

a U-shaped retaining bracket formed by a base and two leg members upstanding from said base and tapered inward as they extend away from said base so that said retaining bracket has a substantially dovetail shaped cross-sectional configuration;

a pair of clear flexible molded plastic substantially planar pieces, said pieces each having a face surface and a predetermined thickness and being substantially identical to one another and adapted to be attached to one another and mounted along a bottom edge in said retaining bracket; and an insert formed as a U-shaped channel member whose overall dimensions are slightly smaller than said retaining bracket for mounting within said retaining bracket, said channel member having a base and first and second wall members upstanding perpendicularly from said base and at least one interior longitudinal wall member upstanding from said base between said first and second wall members thereby forming two longitudinal channels within said U-shaped channel member, each of said channels being slightly larger than said predetermined thickness of said planar pieces so that said channels are capable of releasably accepting said bottom edge of said respective planar piece therein, each of said first and second wall members including an outwardly projecting rib on its exterior surface proximate said base and extending along the length of said first and second wall members for engagement with said retaining bracket so that when said planar pieces are positioned within said channel member and said channel member is mounted within said retaining bracket said leg members of said retaining bracket bias said first and second wall members and said planar pieces toward each other to form a bearing surface between said first and second wall members and said ribs restrain said channel member and said planar pieces within said retaining bracket.

* * * * *